United States Patent [19]

Mizusawa

[11] Patent Number: 4,893,850

[45] Date of Patent: Jan. 16, 1990

[54] OPENING/CLOSINC DEVICE

[75] Inventor: Akira Mizusawa, Utsunomiya, Japan

[73] Assignee: Nifco, Inc., Yokohama, Japan

[21] Appl. No.: 272,369

[22] Filed: Nov. 17, 1988

[30] Foreign Application Priority Data

Nov. 30, 1987 [JP] Japan ..... 62-180959[U]

[51] Int. Cl.[4] ..... E05C 19/12

[52] U.S. Cl. ..... 292/128; 292/304; 292/DIG. 55; 292/DIG. 63

[58] Field of Search ..... 292/DIG. 11, DIG. 17, 292/31, 54, 128, 99, 101, 87, 198, 228, 304, DIG. 55, DIG. 63; 16/231, 232; 49/193

[56] References Cited

U.S. PATENT DOCUMENTS

| | | | |
|---|---|---|---|
| Re. 29,816 | 10/1978 | Winsor et al. | 16/232 |
| 395,226 | 12/1888 | Hamilton | 16/232 |
| 505,480 | 9/1893 | Pletcher | 16/232 |
| 600,318 | 3/1898 | Pletcher | 292/DIG. 17 X |
| 938,131 | 10/1909 | Dutschke | 292/101 |
| 2,031,302 | 2/1936 | Clark | 292/128 X |
| 2,523,727 | 9/1950 | Sevison | 292/128 |
| 3,069,541 | 12/1962 | Thomsen et al. | 16/232 X |
| 3,161,923 | 12/1964 | Crain | 292/128 |
| 3,760,333 | 9/1973 | Stieler | 292/101 X |
| 4,270,668 | 6/1981 | Berfield | 292/87 X |
| 4,501,378 | 2/1985 | Berfield | 292/87 X |
| 4,598,940 | 7/1986 | Degroat | 292/DIG. 17 X |

FOREIGN PATENT DOCUMENTS

| | | | |
|---|---|---|---|
| 173507 | of 0000 | Fed. Rep. of Germany | 16/232 |
| 2260880 | 6/1973 | Fed. Rep. of Germany | 292/128 |
| 1781476 | 9/1979 | Fed. Rep. of Germany | 292/128 |
| 62-12042 | 3/1987 | Japan . | |

*Primary Examiner*—Gary L. Smith
*Assistant Examiner*—Michael J. Milano
*Attorney, Agent, or Firm*—Schwartz & Weinrieb

[57] ABSTRACT

An opening/closing device for detachably coupling a closure member to the open edge portion of a body includes a locking shaft provided upon the side of the body, a bracket secured to the closure member and having a notch defined therein, an operating lever having an end portion provided with a pawl portion for engaging the locking shaft within the open end region of the notch, and spring means provided upon the operating lever for biasing the pawl portion in the direction of engagement with the locking shaft. When the closure member is set upon the body, the notch is engaged with the locking shaft. The closure member is closed relative to the body by the engagement of the notch and pawl portion with the locking shaft. When the closure member is opened in a cantilevered state, this device serves as a hinge. By operating the operating lever against the biasing force of the spring means so as to disengage the pawl portion from the locking shaft, the closure member is separated from the body.

20 Claims, 4 Drawing Sheets

OPENING/CLOSING DEVICE

FIELD OF THE INVENTION

This invention relates to an opening/closing device for coupling a closure member such as, for example, a lid or door to a body, and more particularly to an opening/closing device which serves the function of detachably coupling a closure member to a body while also serving in an alternative functional mode as a hinge when opening and closing the closure member relative to the body.

DESCRIPTION OF THE PRIOR ART

A lid provided upon a console or similar container can be opened and closed about one end thereof which is coupled by means of a hinge or the like to the container body, while its other end is detachably coupled by means of an opening/closing device to the container body. Japanese Utility Model Publication Sho 62-12042 discloses an examle of an opening/closing device which can be used for detachably coupling such a lid to a container.

Such an opening/closing device is essential not only for the lid of the container as noted above but also for a housing door or doors of other storage or container units, and various improved devices have been proposed depending upon the prticular intended use.

Prior art opening/closing devices of this type are improved in view of the operability and mechanical strength of the coupling. However, these prior art opening/closing devices only function as a means for detachably coupling the closure member such as a lid or a door to the body. Therefore, with the prior art opening/closing devices, it is possible to achieve only one or the other of two arrangements, namely, one in which an opening/closing device is used for each of the two ends of a closure member so that the closure member can be removed from and also opened and closed with respect to a body, and the other in which an opening/-closing device is used at one end of a closure member while a hinge or the like is used at the other end of the closure member for opening the closure member in a cantilevered manner and for closing the member from the open state.

Sometimes, however, it is desired to be able to open or close a closure member in opposite directions for different functions modes and also be able to completely remove the closure member from the body. As an example, an automobile center console lid can be opened and closed by means of a hinge, but there are situations in which the lid is desired to be operated by passengers seated upon both the front and rear seats. In such a case, it is convenient for a passenger seated upon the front seat to use the opening/closing device at the rear end of the lid as a hinge for opening and closing the lid, while it is convenient for a passenger seated upo the rear seat to use the opening/closing device at the front end of the lid as a hinge. A similar situation applies to the driver and a person seated within the front of the vehicle upon the other side of the console from the driver, that is, the functional mode to be used by means of the driver and passenger.

Furthermore, in the case of a door provided upon a storage or other container-type unit, it is sometimes desired to change the direction of opening or closing the door or to temporarily remove the door depending upon the location at which the unit in installed. In order to change the direction of opening or closing the door, however, it is necessary to change not only the position of the hinge but also the opening/closing device itself. In many cases, therefore, the change is impossible, and it becomes inevitable to change the design of the body itself.

OBJECT OF THE INVENTION

The present invention has been accomplished in light of the above situation, and its object is to provide an opening/closing device which serves the function of detachably coupling a closure member to a body and also serves as a hinge, so that it may be used for each of the two ends of the closure member so as to removably couple the closure member to the body or to permit the closure member to be opened or closed in opposite directions by changing the effective position of the hinge.

SUMMARY OF THE INVENTION

In order to attain the above object of the invention, there is provided an opening/closing device for detachably coupling a closure member to an open edge portion of a body, which comprises a locking shaft provided upon the side of the body, a bracket secured to the closure member and having a notch engaged with the locking shaft when the closure member is mounted upon the open edge portion of the body, an operating lever having an edge portion provided with a pawl portion for engaging the locking shaft within the vicinity of the open end of the notch, and spring means provided upon the operating lever and biasing the pawl portion thereof in the direction of engagement the locking shaft, the closure member being closed relative to the body as a result of the engagement of the notch of the bracket and pawl portion of the operating lever with the locking shaft. The opening/closing device also serves as a hinge when the closure member is opened in a cantilever manner, the engagement of the pawl portion with the locking shaft being released so as to permit separation of the closure member from the body by operating the operating lever against the biasing force of the spring means.

In order to couple the closure member to the body, the closure member is mounted upon the body with the operating lever operated against the biasing force of the spring means, thus causing the notch to be engaged with the locking shaft. Then, the operating lever is released. As a result, the operating lever is pivoted by means of the biasing force of the spring means, thus causing the pawl portion to engage with the locking shaft within the vicinity of the open end of the notch. Thus, the closure member is coupled to the body. In this coupled state, the notch and pawl portion are engaged with the locking shaft in opposite directions, so that the opening/closing device can serve as a hinge when opening the closure member in a cantilevered manner and when closing the member from the open state.

In order to remove the closure member from the body by releasing the engagement of the pawl portion from the locking shaft, the operating lever is operated against the biasing force of the spring means, thus releasing the engagement of the pawl portion with the locking shaft. Then, the closure member is able to be separated from the body.

BRIEF DESCRIPTION OF THE DRAWING

The above and other objects and features of the invention will become more apparent from the following detailed description with reference to the accompanying drawings wherein.

DETAILED DESCRIPTION OF THE PREFERRED EMBODIMENT

Figure 1:
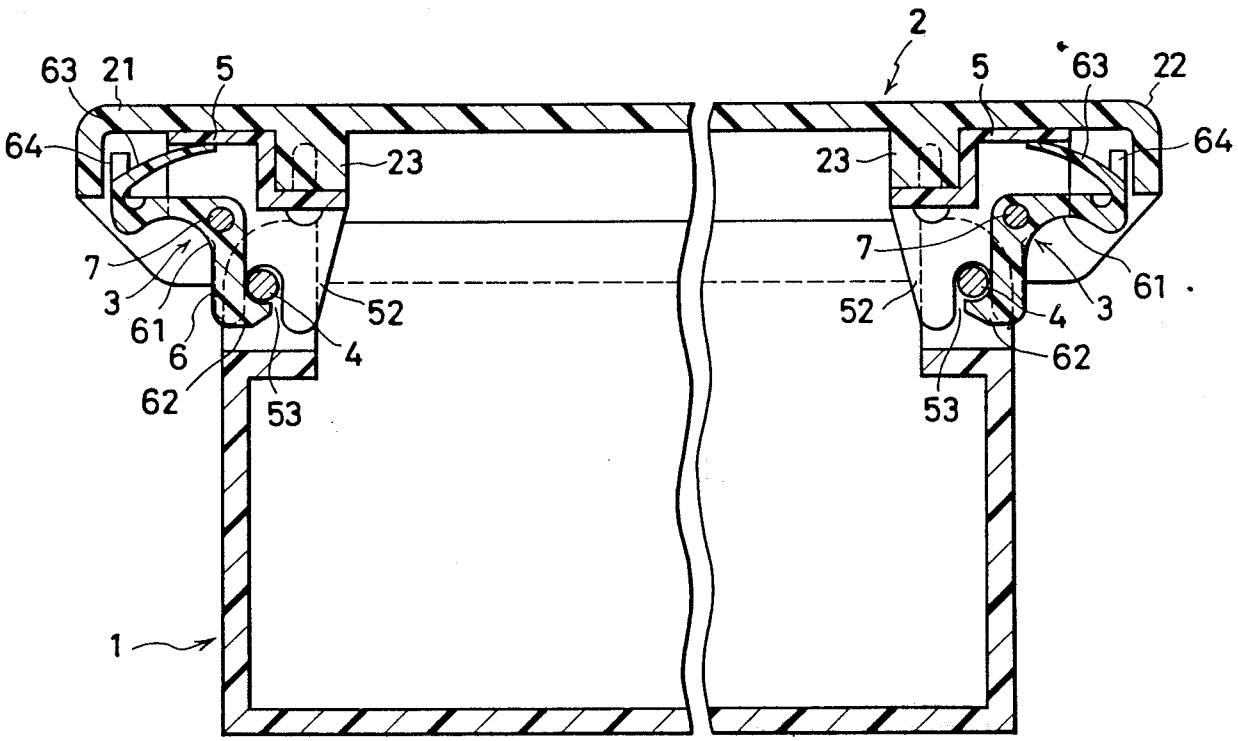
FIG. 1 is a sectional view showing a console incorporating the opening/closing device according to the invention.
Figure 2:
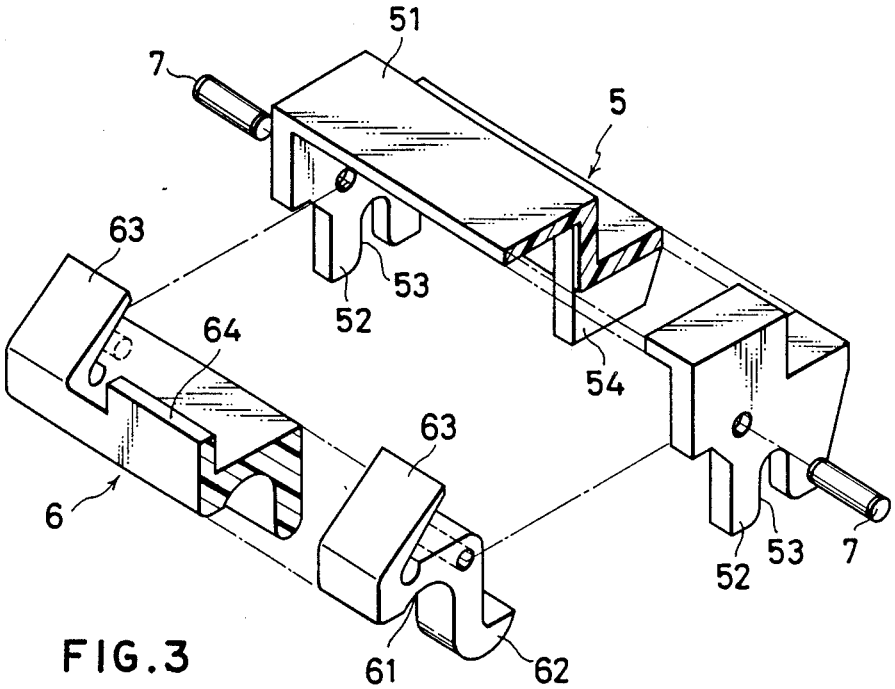
FIG. 2 is an exploded perspective view showing the opening/closing device of FIG. 1.
Figure 3:
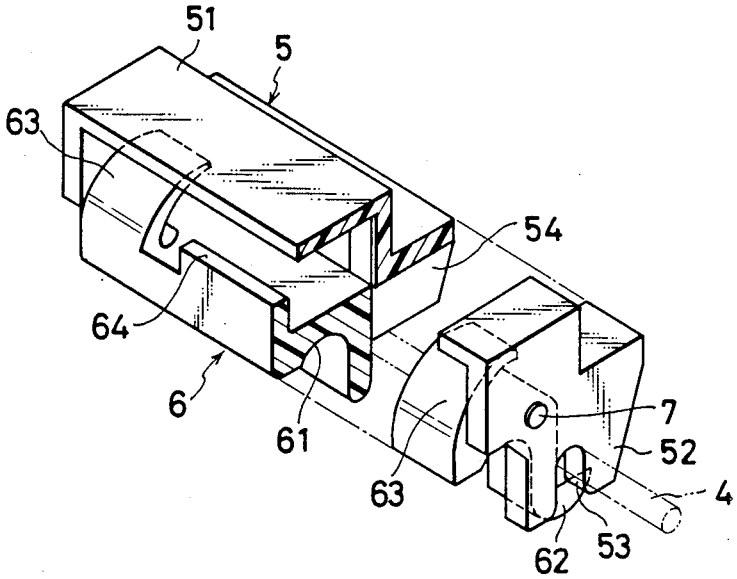
FIG. 3 is a perspective view, partly broken away, showing the opening/closing device of FIG. 2 in the assembled state.

FIG. 1 shows an embodiment of the opening/closing device according to the invention which is used upon a console within a car passenger compartment or the like, and FIGS. 2 and 3 show the opening/closing device in detail.

The illustrated console consists of a box-like body 1 with opposite side and front and rear walls and a lid 2 having a substantially U-shaped sectional profile. The lid 2 has each of its front and rear edges 21 and 22 detachably coupled by means of the same opening/closing device 3 to the body 1.

The opening/closing device 3 includes a locking shaft 4 mounted within the sides of the body 1, a bracket 5 secured to the under surface of the lid 2 and an operating lever 6 pivotally mounted upon the bracket 5.

The locking shaft 4 has its opposite ends rotatably mounted within portions of the side walls of the body 1. The locking shaft 4 extends parallel to and at a fixed distance from the front and rear walls.

The bracket 5 and operating lever 6 both consist of resin moldings.

The bracket 5 comprises a structure consisting of an elongate portion 51 having a length smaller than the width of the lid 2 and having a sectional profile having an intermediate stepped portion and support portions 52 each of which is integral with each end of the elongate portion. The intermediate stepped portion of the elongate portion 51 is mounted upon a mounting portion downwards 23 projecting from the under surface of the lid 2 and is secured by means of screws to the mounting portion 23 (see FIG. 1). Each support portion 52 has a notch 53 formed within the lower end portion thereof. The notch 53 is automatically fitted upon the locking shaft 4 when the lid 2 is closed relative to the body 1. Reference numeral 54 designates a stopper projecting downwardly from a central portion of the under surface of the elongate portion 51. The stopper 54 restricts the angle of rotation of the operating lever 6 in the engaged direction as shwn in FIG. 3.

The operating lever 6 has a substantially L-shaped sectional profile. It is rotatably mountd upon the bracket 5 by interposing it between the two supporting portions 52 of bracket 5 and pivotally coupling its opposite ends to the supporting portions 52 by means of pins 7.

The operating lever 6 has an L-shaped sectional profile portion, and a horizontal portion thereof serves as an operating portion 61. Lever 6 also has a pawl portion 62 provided at the lower end of the vertical portion of the L-shaped sectional profile portion and leaf spring portions 63 projecting from the edge of the horizontal portion of the L-shaped sectional profile portion adjacent to the opposite lateral ends thereof.

The operating portion 61 has an inwardly concave curved surface. The rotation of the operating lever 6 pivotably coupled to the support portions 52 at the opposite ends of bracket 5 is accomplished by means of one's finger tips applied to the inwardly concave curved suface. Each pawl portion 62 projects in the opposite direction with respect to that of the operating portion 61 and is caused to engage the locking shaft 4 within the vicinity of the open end of the notches 53 of the supporting portions 52 when the operating lever 6 is rotated by means of the biasing force of the leaf spring portions 63. As shown in FIG. 3, the locking shaft 4 is retained within the notches 53 against detachment by means of the pawl portions 62 projecting into the notches 53. The notches 53 serve as bearings for the locking shaft 4, when they serve as hinges when the lid 2 is opened in a cantilevered manner state.

The leaf spring portions 63 integrally extend obliquely upwardly from the edge of the operating portion 61 such that their end portions elastically engage with the inner under surface of the elongate portion 51 of the bracket 5 when the bracket 5 and operating lever 6 are assembled together. The leaf spring portions 63 bias the operating lever 6 in the direction of rotation about the pins 7 so as to engage the pawl portions 62 with the locking shaft 4. The rotation of the operating lever 6 is restricted by means of the engagement of the outer surface of the vertical portion of its L-shaped sectional profile portion with the stopper 54. Thus, the pawl portions 62 are not biased against the locking shaft 4.

The operating portion 61 has an integral projection 64 extending upwardly from its outer edge portion between the pair of pawl portions 62. When the operating lever 6 is rotated against the biasing force of the leaf spring portions 63, its rotation is restricted as the projection 64 strikes the inner under surface of the elongate portion 51, so that the leaf spring porton 63 will not be excessively flexed.

Figure 4:
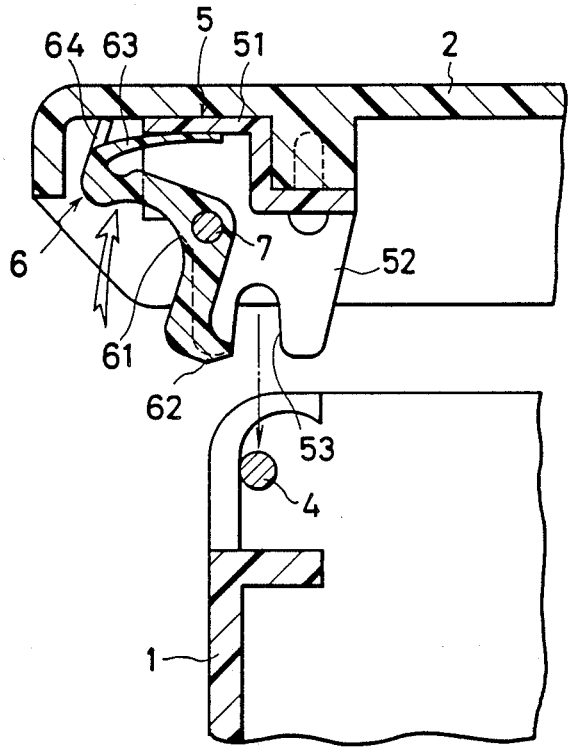
FIG. 4 is a fragmentary sectional view showing the opening closing device with the operating lever in the operated state.
Figure 5:
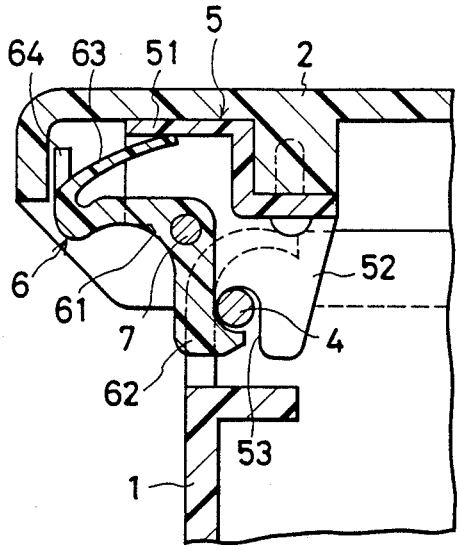
FIG. 5 is a fragmentary sectional view showing the opening/closing device in a coupled state.
Figure 6:
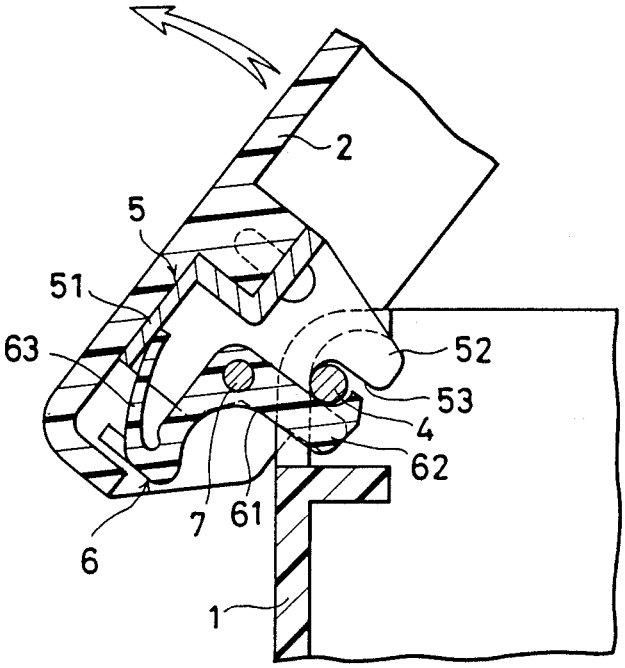
FIG. 6 is a fragmentary sectional view showing the opening/closing device used as a hinge.

FIGS. 4 to 6 illustrate the operation of the opening/closing device 3. Although the body 1 and lid 2 are detachably coupled toether by means of the pair of opening/closing devices 3 provided at the front and rear of the body and lid assembly as shown in FIG. 1, only a single opening/closing device 3 is shown in FIGS. 2 to 6.

When mounting the lid 2 upon the body 1, the operating lever 6 of each device 3 is pivoted upwardly against the biasing force of the leaf spring portions 63 by means of ones finger tips applying the pivoting force to the operating portion 61, thus causing outward pivotal movement of the pawl portions 62 projecting toward the open ends of the notches 53. In this state, the lid 2 is mounted upon the body 1, whereby the notches 53 are mounted upon the locking shaft 4. Furthermore, when the operator's biasing force is removed such that the operating lever 6 is released, it is pivoted by means of the biasing force of the leaf spring portions 63 back toward its normally engaged position. As a result, the pawl portions 62 are moved toward the open ends of the notches 53, and the lid 2 is engaged with the locking shaft 4.

The mounting of the lid 2 upon the body 1 can also be effected without necessarily pivoting the operating lever 6 by means of ones finger tips but merely by setting the lid 2 upon the body 1. More specifically, in the instant embodiment the pawl portions 62 each have a tapered outer surface. Thus, when the lid 2 is set upon the body 1, the tapered portion of each pawl portion 62 is brought into contact with the locking shaft 4 while receiving the weight of the lid 2. Thus, the operating lever 6 is pivoted about the pins 7 such that the pawl portions 62 are forced toward the outer side of the notches 53, and in addition the ends of the pawl portions 62 clear the locking shaft 4. Subsequently, the initial locked state is restored as a result of the biasing force of the leaf spring portions 63.

In order to easily or readily remove the lid 2 from the body 1, the operating portion 61 of the operating lever 6 of each opening/closing device 3 is urged against the biasing force of the leaf spring portions 63. As a result, the pawl portions 62 projecting into the openings of the notches 53 are pivoted outwardly. In this state, the lid 2 can be raised from the body 1.

In order to mount or remove the lid 2 uponor from the body, both opening/closing devices 3 must be operated. However, the two devices 3 need not be operated simultaneously, but may be operated sequentially.

When the lid 2 is opened in a cantilevered state, the operating portion 61 of the operating lever 6 of either one of the opening/closing devices 3 is urged against the biasing force of the leaf spring portions 63 so as to cause outward movement of the pawl portions 62 extending into the openings of the notches 53. In this state, the lid 2 is pivoted wherein the other opening/closing device 3 serves as a hinge, as shown in FIG. 6. Of course when it is desired to open the lid 2 in the opposite direction, the operating portion 61 of the operating lever 6 of the other opening/closing device 3 is actuated in the foregoing manner.

As has been shown, by providing the opening/closing device 3 for each of the front and rear portions of the lid 2, the lid can be detachably mounted upon the body 1. In addition, the lid can be opened and closed in either one of opposite directions by selectively utilizing one or the other of the opening/closing devices 3 as a hinge. Thus, the lid 2 may be opened and closed in three different ways or modes, the most desired one of which may be selected in accordance with the circumstances of use. It is thus possible to greatly increase the versatility of the ways of using the body 1 and the operation of opening and closing the lid 2.

Furthermore, with the opening/closing device 3 according to the invention, only the locking function may be utilized alone, as in the prior art opening/closing device. In this case, one of the opening/closing devices 3 shown in FIG. 1 is replaced with, for instance, a well-known hinge. As a result, the lid 2 may be opened in a cantilevered state and closed from this state with one of the opening/closing devices 3 serving as a hinge, while it is detachably coupled to the body 1 by means of the other opening/closing device 3.

Furthermore, it is possible to utilize only the hinge function of the opening/closing device 3 according to the invention as with the prior art hinge or the like. In this case, one of the opening/closing devices 3 in FIG. 1 is either omitted or replaced with a prior art opening/closing device. Thus, the lid can be opened in a cantilevered state or closed from this state about the pivotal axis of the other opening/closing device 3. Furthermore, if necessary, it can of course be removed from the body 1.

In accordance with the above structure according to the invention, the operating lever 6 is provided with integral leaf spring portions 63 with the aim of simplifying the maintenance of parts and assembling operations. However, it is possible to use separate spring means in place of the leaf spring portions. Such separate spring means may consist of a piece of wirework. Furthermore, in the above embodiment the range of rotation of the operating lever 6 is defined by means of the stopper 54 provided upon the bracket 5 and by means of projection 64 provided upon the operating lever 6. However, it is alternatively possible to use different stopper means.

Furthermore, while in the above embodiment the opening/closing device 3 is utilized for a lid 2 upon a body 1, such is by no means so limited, and it is possible to use the opening/closing device according to the invention upon a house door, a housing door, and lids for various containers as well.

As has been described in the foregoing, with the opening/closing device according to the invention it is possible to obtain the function as a hinge for opening a closure member in a cantilevered state and closing the same from that state in addition to the function of detachably coupling the closure member to a body.

Thus, where one end of the closure member is coupled to the body by means of the opening/closing device according to the invention, the closure member can be opened in a cantilevered state and closed from this state with the device serving as a hinge and, if desired, the closure member can be removed from the body.

Where both ends of the closure member are coupled to the body by means of opening/closing devices according to the invention, the two opening/closing devices at the two ends can be selectively utilized as hinges. Thus, the closure member can be opened in opposite directions in a cantilevered state and closed from this state, while it can also be removed from the body. This is very convenient and beneficial in the industry.

Obviously, many modifications and variations of the present invention are possible in light of the above teachings. It is therefore to be understood that within the scope of the appended claims, the present invention may be practiced otherwise than as specifically described herein.

What is claimed is:

1. An opening/closing device for detachably coupling an end portion of a closure member to an end portion of a body having an opening to be opened and closed by said closure member, comprising:

a locking shaft fixedly mounted upon said body within the vicinity of said end portion of said body;

notch means defined within said closure member for engaging a first portion of said locking shaft of said body when said closure member is disposed at its closed position upon said body;

an operating lever, including pawl means formed upon one end thereof, pivotably mounted upon said closure for movement member between a first position at which said pawl means is engaged with a second portion of said locking shaft so as to cooperate with said notch means for retaining said closure member at said closed position upon said body, and a second position at which said pawl means is disengaged from said locking shaft so as to permit said closure member to be moved from said closed position to an open position; and spring means operatively connected to said operating lever and engaged with an inner undersurface portion of said closure member for biasing said operating lever and said pawl means thereof toward said first position at which said pawl means is engaged with said second portion of said locking shaft so as to retain said closure member at said closed position upon said body.

2. An opening/closing device as set forth in claim 1, wherein:

said body comprises a box-like container; and said opening is formed within a top surface of said box-like container.

3. An opening/closing device as set forth in claim 1, further comprising:

bracket means fixedly secured to said undersurface portion of said closure member for pivotably supporting said operating lever.

4. An opening/closing device as set forth in claim 3, wherein:

said notch means are formed within dependent sidewall portions of said bracket means.

5. An opening/closing device as set forth in claim 1, wherein:

said spring means comprises a leaf spring integrally formed with a second end of said operating lever.

6. An opening/closing device as set forth in claim 3, wherein:

said operating lever and said bracket means comprise resin moldings.

7. An opening/closing device as set fort in claim 3, further comprising:

stopper means mounted upon said bracket means for limiting the pivotable movement of said operating lever toward said first position.

8. An opening/closing device as set forth in claim 1, wherein:

said operating lever has a substantially inverted L-shaped configuration comprising a vertical leg and a horizontal leg; and fingertip concave recess means are defined within an undersurface portion of said horizontal leg for facilitating said pivotable movement of said operating lever against the biasing force of said spring means.

9. An opening/closing device as set forth in claim 1, further comprising:

stopper means defined upon said operating lever for limiting the pivotable movement of said operating lever toward said second position.

10. An opening/closing device as set forth in claim 1, wherein:

said pawl means have beveled free end portions for engaging said locking shaft of said body whereby said operating lever will be automatically pivoted toward said second position against the biasing force of said spring means as a result of said beveled portions of said pawl means engaging said locking shaft of said body as said closure member is moved toward said closed position.

11. An opening/closing system for detachably connecting opposite end portions of a closure member to opposite end portions of a body having an opening, defined within a surface thereof, to be opened and closed by said closure member, comprising:

a locking shaft fixedly mounted upon said body within the vicinity of each end portion of said body;

notch means defined within each end of said closure member for engaging a first portion of each locking shaft of said body when each of said ends of said closure member is disposed at a closed position upon said body;

an operating lever, including pawl means formed upon one end thereof, pivotably mounted upon each of said ends of said closure member for movement between a first position at which said pawl means thereof is engaged with a second portion of its respective locking shaft so as to cooperate with a respective one of said notch means for retaining a respective end of said closure member at said closed position upon a respective end of said body, and a second position at which said pawl means thereof is disengaged from its respective locking shaft so as to permit the respective end of said closure member to be moved from said closed position to an open position; and spring means operatively connected to each one of said operating levers and engaged with a respective undersurface end portion of said closure member for biasing a respective inner one of said operating levers and said pawl means thereof toward said first position at which said pawl means is engaged with said second portion of its respective locking shaft so as to retain the respective end of said closure member at said closed position upon said respective end of said body, whereby when one of said operating levers is pivotably moved toward said second position so as to release said pawl means thereof from its engagement with its respective locking shaft at one end of said body, said closure member can be pivotably opened relative to said body at said one end of said body as a result of pivotal movement about said locking shaft disposed at the other end of said body, while when both of said operating levers are pivotably moved toward said position so as to release both of said pawl means from their engaged positions with said locking shafts at both ends of said body, said closure member can be removed from said body.

12. A system as set forth in claim 11, wherein:

said body comprises a box-like container; and said opening is formed within a top surface of said box-like container.

13. A system as set forth in claim 11, further comprising:

bracket means fixedly secured to said undersurface surface portions of said closure member at each of said end of said closure member.

14. A system as set forth in claim 13, wherein:

said notch means are formed within dependent sidewall portions of each of said bracket means.

15. A system as set forth in claim 11, wherein:

said spring means comprises a leaf spring integrally formed with a second end of each one of said operating levers.

16. A system as set forth in claim 13, wherein:

each one of said operating levers and said bracket means comprises a resin molding.

17. A system as set forth in claim 13, further comprising:

stopper means mounted upon each one of said bracket means for limiting the pivotable movement of each one of said operating levers toward said first position.

18. A system as set forth in claim 11, wherein:

each one of said operating levers has a substantially inverted L-shaped configuration comprising a vetical leg and a horizontal leg; and fingertip concave recess means defined within an undersurface portion of said horizontal leg of each operating lever for facilitating said pivotable movement of each one of said operating levers against the biasing force of its respective spring means.

19. A system as set forth in claim 11, further comprising:

stopper means defined upon each one of said operating levers for limiting the pivotable movement of each one of said operating levers toward said second position.

20. A system as set forth in claim 11, wherein:

each one of said pawl means has a beveled free end portion for engaging each one of said locking shafts of said body whereby each one of said operating levers will be automatically pivoted toward said second position against the biasing force of its respective spring means as a result of said beveled portion of each one of said pawl means engaging its respective locking shaft of said body as each end of said closure member is moved toward said closed position.

* * * * *